US009835124B2

(12) United States Patent
Koeninger et al.

(10) Patent No.: US 9,835,124 B2
(45) Date of Patent: Dec. 5, 2017

(54) FUEL INJECTOR

(71) Applicant: Robert Bosch GmbH, Stuttgart (DE)

(72) Inventors: Andreas Koeninger, Neulingen-Goebrichen (DE); Gerhard Suenderhauf, Tiefenbronn (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 14/915,283

(22) PCT Filed: Aug. 5, 2014

(86) PCT No.: PCT/EP2014/066770
§ 371 (c)(1),
(2) Date: Feb. 29, 2016

(87) PCT Pub. No.: WO2015/028261
PCT Pub. Date: Mar. 5, 2015

(65) Prior Publication Data

US 2016/0215745 A1 Jul. 28, 2016

(30) Foreign Application Priority Data

Aug. 30, 2013 (DE) ..... 10 2013 217 371

(51) Int. Cl.
*F02M 61/00* (2006.01)
*F02M 61/06* (2006.01)
(Continued)

(52) U.S. Cl.
CPC ..... *F02M 61/06* (2013.01); *B05B 1/14* (2013.01); *B05B 1/1672* (2013.01);
(Continued)

(58) Field of Classification Search
CPC .. F02M 61/06; F02M 61/182; F02M 61/1893; F02M 61/1886; F02M 61/18;
(Continued)

(56) References Cited

U.S. PATENT DOCUMENTS 1,833,080 A * 11/1931 Kenworthy ..... F02M 61/06 239/584
3,559,892 A * 2/1971 De Luca ..... F02M 45/08 239/533.4

(Continued)

FOREIGN PATENT DOCUMENTS

DE 2803774 8/1979
DE 10207189 9/2002

(Continued)

OTHER PUBLICATIONS

International Search Report for Application No. PCT/EP2014/066770 dated Oct. 17, 2014 (English Translation, 3 pages).

*Primary Examiner* — Steven J Ganey
(74) *Attorney, Agent, or Firm* — Michael Best & Friedrich LLP

(57) ABSTRACT

The invention relates to a fuel injector for internal combustion engines for injecting fuel at high pressure, comprising a pressure chamber formed in an injector body, in which pressure chamber a nozzle needle is arranged in a longitudinally movable manner, which nozzle needle has a cone region tapered in a combustion chamber direction and a pin region having a constant diameter d23 at a combustion-chamber end of the nozzle needle. The injector body has a substantially conical nozzle needle seat, from which a first injection opening extends, and a blind hole, which adjoins the nozzle needle seat on the combustion chamber side. The blind hole has a cylindrical segment, which has the diameter d31, and a hole base, from which a second injection opening extends. The cone region of the nozzle needle interacts with the nozzle needle seat and thereby opens and closes the first injection opening and the second injection opening with respect to the pressure chamber. During a partial stroke of the nozzle needle, the first injection opening and the second injection opening are connected to each other by means of
(Continued)

a throttle gap, which is formed in the blind hole between the pin region and the wall of the blind hole, and the throttle gap remains constant at least over the partial stroke of the nozzle needle.

14 Claims, 3 Drawing Sheets

(51) Int. Cl.

| | |
|---|---|
| ***F02M 61/18*** | (2006.01) |
| ***F02M 61/20*** | (2006.01) |
| ***B05B 1/30*** | (2006.01) |
| ***B05B 1/16*** | (2006.01) |
| ***B05B 1/14*** | (2006.01) |

(52) U.S. Cl.
CPC ..... *B05B 1/3013* (2013.01); *F02M 61/18* (2013.01); *F02M 61/182* (2013.01); *F02M 61/1806* (2013.01); *F02M 61/1893* (2013.01); *F02M 61/20* (2013.01); *F02M 61/1886* (2013.01)

(58) Field of Classification Search
CPC ..... F02M 61/20; F02M 61/1806; B05B 1/14; B05B 1/3013; B05B 1/1672
USPC ..... 239/533.3, 533.4, 533.8, 533.9, 533.11, 239/533.12, 548, 556–558, 560–563, 584
See application file for complete search history.

(56) References Cited

U.S. PATENT DOCUMENTS

| | | | | |
|---|---|---|---|---|
| 4,200,237 | A * | 4/1980 | Urlaub | F02M 61/182 239/533.12 |
| 4,360,162 | A | 11/1982 | Eckert | |
| 4,506,833 | A * | 3/1985 | Yoneda | F02M 61/18 239/533.4 |
| 5,947,389 | A | 9/1999 | Hasegawa et al. | |

FOREIGN PATENT DOCUMENTS

| | | | |
|---|---|---|---|
| EP | 1283336 | | 2/2003 |
| FR | 1190361 | | 10/1959 |
| JP | S547020 | A | 1/1979 |
| JP | S61130487 | A | 6/1986 |
| JP | H10141179 | A | 5/1998 |
| JP | H11280610 | A | 10/1999 |
| JP | 2000145586 | A | 5/2000 |
| JP | 2002322957 | | 11/2002 |
| JP | 2005517122 | A | 6/2005 |
| JP | 2006063951 | A | 3/2006 |
| WO | 2011033036 | | 3/2011 |

* cited by examiner

FUEL INJECTOR

BACKGROUND OF THE INVENTION

The invention relates to a fuel injector for internal combustion engines, of the kind which can be used for injecting fuel under high pressure into the combustion chamber of an internal combustion engine.

A fuel injection nozzle or fuel injector for internal combustion engines is known from German Laid-Open Application DE 29 20 100 A1. In the known fuel injector, a nozzle needle is arranged in a longitudinally movable manner in an injector body and interacts by means of a sealing edge formed on the nozzle needle with a nozzle needle seat formed on the injector body and opens and closes a plurality of first injection openings by means of its longitudinal movement. Adjoining this at the combustion-chamber end, the nozzle needle has a pin region, which projects into a blind hole formed in the injector body and thereby closes a plurality of second injection openings. Up to a partial stroke of the nozzle needle, fuel flows into the combustion chamber of the internal combustion engine only through the first injection openings, while the pin region seals off the second injection openings. After the partial stroke, the pin region emerges from the blind hole and thus exposes the second injection openings. A step-shaped injection characteristic which includes good suitability for very small quantities can thereby be achieved. However, the sealing function of the pin region when projecting into the blind hole requires high accuracy of manufacture and high wear resistance.

SUMMARY OF THE INVENTION

In contrast, the fuel injector according to the invention exhibits less wear with a similar injection characteristic and, at the same time, requires less accuracy of manufacture.

To achieve this, the fuel injector has a pressure chamber, which is formed in an injector body and in which a nozzle needle is arranged in a longitudinally movable manner, which nozzle needle has, at the combustion-chamber end thereof, a cone region, which is tapered in a combustion chamber direction, and a pin region of constant diameter $d_{23}$. The injector body furthermore has a substantially conical nozzle needle seat, from which a first injection opening extends, and a blind hole, which adjoins the nozzle needle seat at the combustion-chamber end and has a cylindrical segment having the diameter $d_{31}$ and a hole base, from which a second injection opening extends. The cone region of the nozzle needle interacts with the nozzle needle seat and thereby opens and closes the first injection opening and the second injection opening with respect to the pressure chamber. At least during a partial stroke of the nozzle needle, the first injection opening and the second injection opening are connected to one another via a throttle gap, which is formed in the blind hole between the pin region and the wall of the blind hole, and the throttle gap remains constant at least over the partial stroke. Owing to the throttle gap, there is no contact or only slight contact between the pin region and the nozzle needle and hence also little or no wear in these regions. Moreover, there can be larger tolerances in manufacture than if the pin region had to perform a sealing function.

In an advantageous embodiment of the fuel injector according to the invention, the difference between the diameter $d_{31}$ of the blind hole and the diameter $d_{23}$ of the pin region is greater than 6 μm and less than 30 μm. Thus, the throttle gap is larger by 3 μm on average, and the selected tolerance chain between the pin region and the wall of the blind hole can be relatively large, at up to 3 μm, as long as the nozzle needle is not subject to transverse forces. At the same time, the gap width must be less than 15 μm to achieve sufficient throttling by the throttle gap.

In another advantageous embodiment, one or more second injection openings are present, and the flow cross section through the throttle gap is smaller than the total flow cross section through the second injection opening or through all the second injection openings. The flow cross section through the throttle gap preferably amounts to 15% . . . 70% of the total flow cross section through the second injection opening or through all the second injection openings over the partial stroke. The fuel supply to the second injection openings is thereby throttled for as long as the throttle gap is present, and this means that the fuel injector is well suited to very small quantities.

It is advantageous if the pin region emerges from the blind hole and the flow cross section into the blind hole is enlarged relative to the throttle gap in the case of strokes which are greater than the partial stroke. As a result, more fuel is supplied to the second injection openings, this being necessary to achieve higher engine power outputs.

In another advantageous embodiment, the nozzle needle has an end region which adjoins the pin region at the combustion-chamber end. This enables the transition from partial engine load to full engine load to be made smoother and hence more economical since the curve of the injection rate against time or stroke is shallower in this transition.

In an advantageous embodiment, the end region is embodied as a cone. As a result, the fuel quantity supplied to the second injection openings increases linearly after the partial stroke, leading to an advantageous injection characteristic, depending on the application.

In another advantageous embodiment, the end region is embodied so as to be substantially cylindrical and has at least one lateral recess. As a result, the nozzle needle projects into the blind hole with a portion widened relative to the pin region, even after the partial stroke, and therefore the axial misalignments between the injector body and the nozzle needle are smaller and hence there is also a lower risk of wear during the closing of the nozzle needle. The shape of the lateral recesses can be configured according to the application, ensuring that the fuel supplied to the second injection openings increases quickly or less quickly after the partial stroke.

It is advantageous if the at least one recess is embodied as a ground flat. The desired reduction in the throttling function after the partial stroke can thereby be achieved in a simple manner through a manufacturing technique.

In another advantageous embodiment, the at least one recess is embodied so as to be substantially semicircular in cross section. The potential area of contact between the end region and the wall of the blind hole is thereby enlarged, leading to better guidance of the nozzle needle in the blind hole and hence also to a lower risk of wear.

It is advantageous if the flow cross section into the blind hole is larger than the total flow cross section through all the second injection openings in the case of a maximum stroke of the nozzle needle which is greater than the partial stroke. As a result, the injection characteristic in the case of the maximum stroke is determined substantially by the geometry of the first and second injection openings; there is virtually no longer any throttling function between the injector body and the nozzle needle. The accuracy of manufacture of the two injection openings is therefore decisive for the maximum stroke, while the tolerances of the throttle gap are of subordinate importance in this respect.

It is advantageous if a plurality of first injection openings and/or a plurality of second injection openings is/are present. Uniform injection of the fuel into the combustion chamber can thereby be achieved.

DETAILED DESCRIPTION

Figure 1:
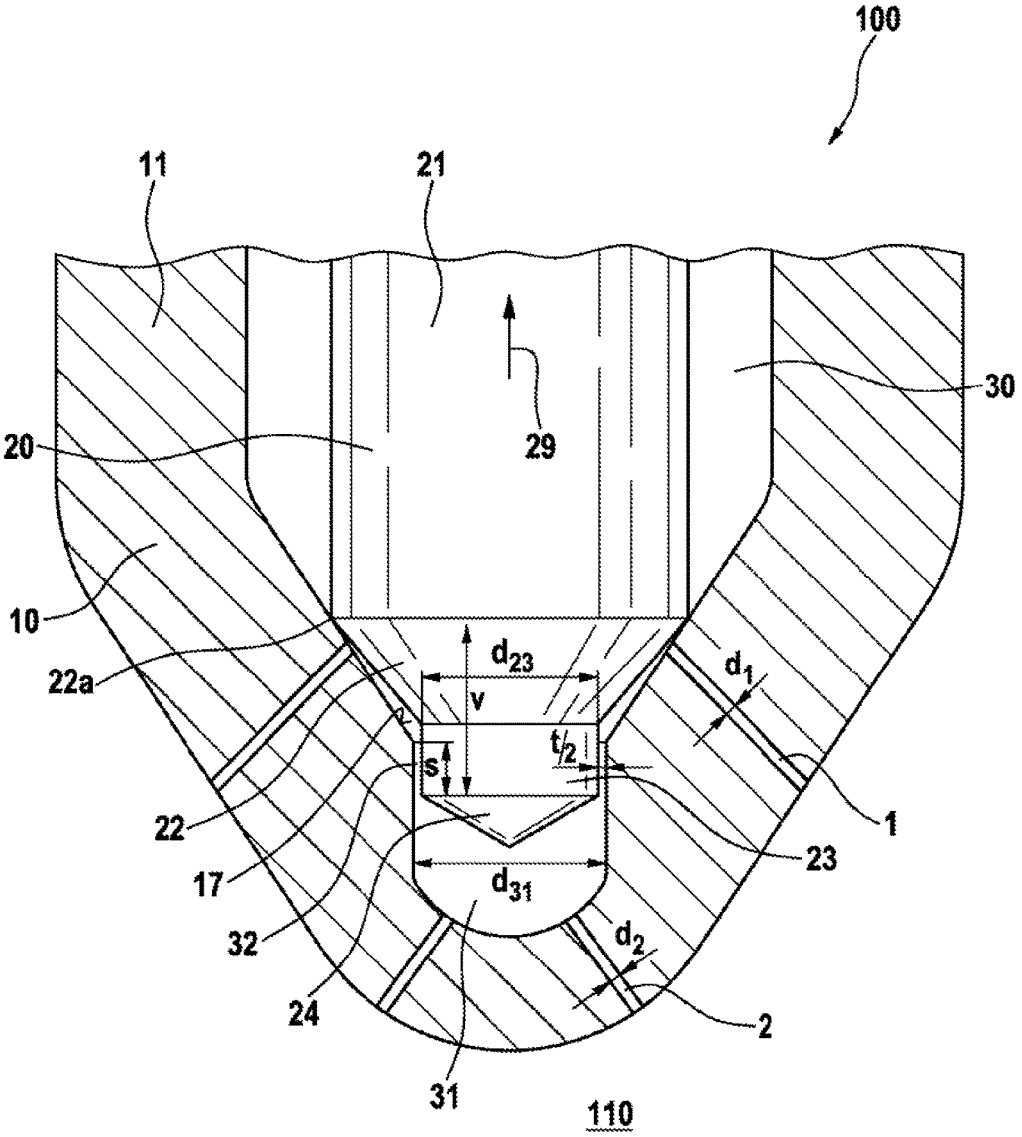
FIG. 1 shows a detail of the fuel injector according to the invention in longitudinal section, wherein only the essential regions are shown.

FIG. 1 shows the end of a fuel injector 100, which projects into the combustion chamber 110 of an internal combustion engine in the installed position. The fuel injector 100 has an injector body 10 with a pressure chamber 30, which is connected via a high-pressure passage (not shown) to a fuel source under high pressure (not shown), e.g. a common rail.

A nozzle needle 20 is arranged in a longitudinally movable manner in the pressure chamber 30. In the detail shown, the nozzle needle 20 has a central part 21 and a cone region 22 arranged on the combustion-chamber end thereof, a pin region 23 and an end region 24. The cone region 22 and the end region 24 are embodied so as to taper in the direction of the combustion chamber 110, and the pin region 23 is embodied so as to be cylindrical with the diameter $d_{23}$.

In the detail shown, the injector body 10 has a cylindrical body stem 11 and, adjoining the latter at the combustion-chamber end, a conical nozzle needle seat 17 and a blind hole 31, which represents part of the pressure chamber 30. At least one first injection opening 1 of diameter $d_1$ leads into the combustion chamber 110 from the blind hole 31, and at least one second injection opening 2 of diameter $d_2$ leads into the combustion chamber 110 from the nozzle needle seat 17. The blind hole 31 has a cylindrical section of diameter $d_{31}$ and, adjoining the latter at the combustion-chamber end, a hole base, which is of rounded design in the illustrative embodiment shown. There can be both one or more first injection openings 1 and one or more second injection openings 2.

In the closed operating state shown, the nozzle needle 20 interacts with the nozzle needle seat 17 at a sealing edge 22*a* formed at the transition from the central part 21 to the cone region 22 and thus closes the hydraulic connection from the pressure chamber 30 to the first injection opening 1 and the second injection opening 2; the blind hole 31 is thereby separated hydraulically from the remainder of the pressure chamber 30. The cylindrical pin region 23 of diameter $d_{23}$ projects into the cylindrical section of the blind hole 31 of diameter $d_{31}$ and thus forms a throttle gap 32 of width t/2 with the wall of the blind hole 31, where $t=d_{31}-d_{23}$. The first injection opening 1 and the second injection opening 2 are continuously connected hydraulically via the throttle gap 32.

To inject fuel through the two injection openings 1, 2, the nozzle needle 20 is moved in the opening direction 29 by a control operation (not shown), e.g. the lowering of a pressure in a control chamber at the end of the nozzle needle 20 remote from the combustion chamber, with the result that the cone region 22 and the sealing edge 22*a* rise from the nozzle needle seat 17 and the hydraulic connection from the pressure chamber 30 to the two injection openings 1, 2 and the blind hole 31 is freed.

Up to a partial stroke s of the nozzle needle 20, the pin region 23 projects into the blind hole 31, and therefore the throttle gap 32 exists in the blind hole 31 between the pin region 23 and the wall of the blind hole 31. During this partial stroke s, the throttling effect due to the throttle gap 32 is greater than the throttling effect due to the second injection opening 2 or the total throttling effect due to all the second injection openings 2; the flow cross section through the throttling gap 32 is thus smaller than the total flow cross section through all the second injection openings 2. To achieve this, the width t/2 of the throttle gap 32 and the clearance t for the pin region 23 within the blind hole 31 should be designed as follows:

The flow cross section through throttle gap $A_{DS}$ is:

$$A_{DS} = \frac{\pi}{4} \cdot d_{31}^2 - \frac{\pi}{4}(d_{31} - t)^2 = \frac{\pi}{4} \cdot (2 \cdot d_{31} \cdot t - t^2)$$

where $d_{31} >> t$:

$$A_{DS} \cong \frac{\pi}{2} \cdot d_{31} \cdot t$$

Flow cross section through all x second injection openings $A_{2.E\ddot{O}}$:

$$A_{2.E\ddot{O}} = x \cdot \frac{d_2^2}{4} \cdot \pi$$

Up to the partial stroke (s), the following should apply: $A_{DS} < A_{2.E\ddot{O}}$ $$\text{i.e. } \frac{\pi}{2} \cdot d_{31} \cdot t < x \cdot \frac{d_2^2}{4} \cdot \pi \Rightarrow t < \frac{x}{2} \cdot \frac{d_2^2}{d_{31}}$$

Up to the partial stroke (s), the following should preferably apply:

$$15\% \cdot A_{2.E\ddot{O}} < A_{DS} < 70\% \cdot A_{2.E\ddot{O}} \Rightarrow \frac{1}{10} \cdot x \cdot \frac{d_2^2}{d_{31}} < t < \frac{3}{10} \cdot x \cdot \frac{d_2^2}{d_{31}}$$

Up to the partial stroke s, the injection characteristic is thus determined substantially by the geometry of the first injection opening 1 and of the throttle gap 32.

After the partial stroke s, the pin region 23 emerges from the blind hole 31, but initially the end region 24 remains in the blind hole 31. Owing to the conical shape of the end region 24, the flow cross section between the blind hole 31 and the nozzle needle 20 widens as the stroke increases. At a maximum stroke v, the pin region 23 and the end region 24 have emerged from the blind hole 31 to such an extent that the flow cross section between the injector body 10 and the nozzle needle 20 is larger than the total flow cross section through all the second injection openings 2. At the maximum stroke v, the injection characteristic is thus determined substantially by the geometry of the first and second injection openings 1, 2.

Figure 2:
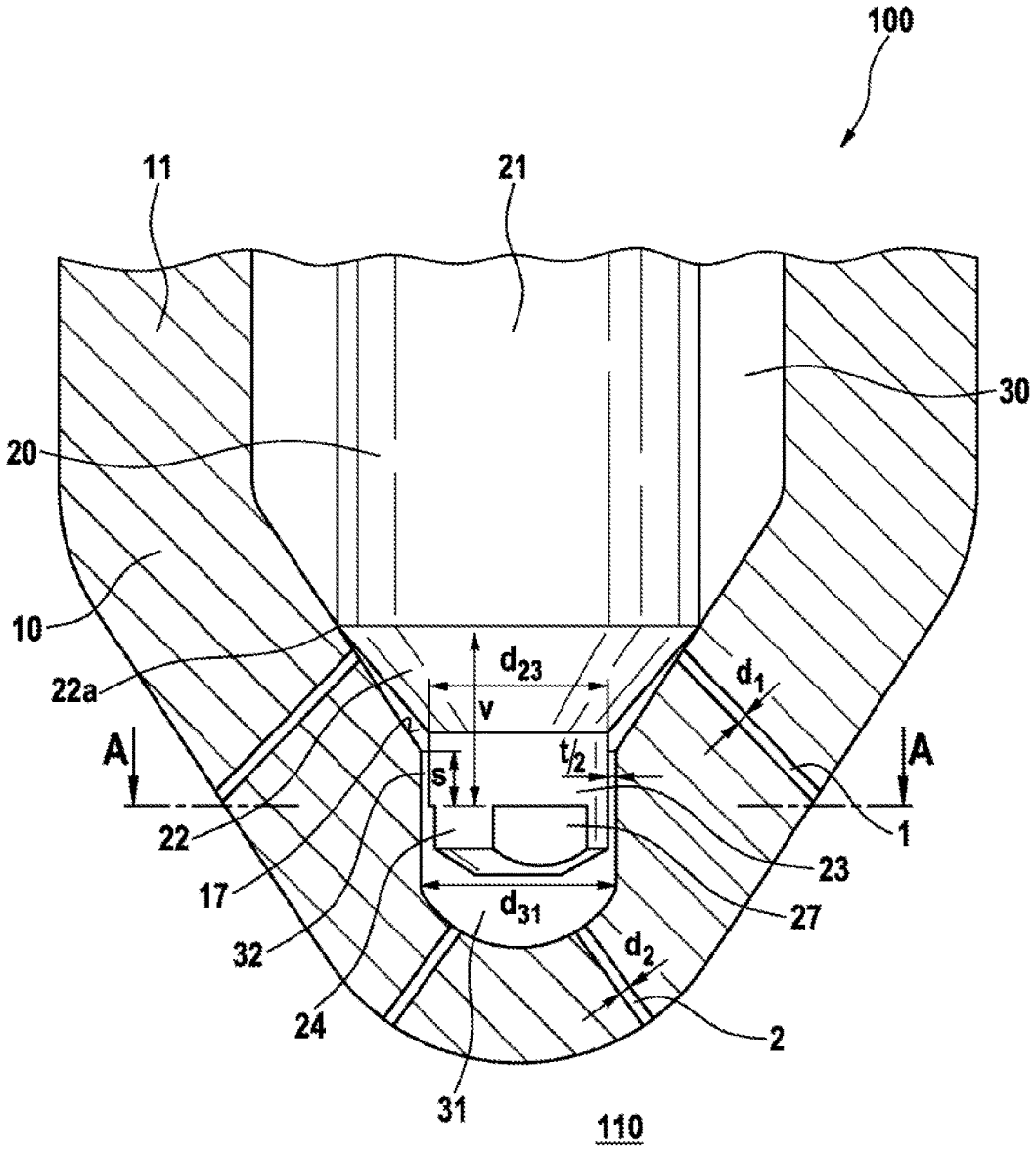
FIG. 2 shows another illustrative embodiment of the fuel injector according to the invention in longitudinal section, wherein likewise only the essential regions are shown.

The illustrative embodiment in FIG. 2 differs from that in FIG. 1 in the embodiment of the end region 24. All the other features are embodied in the same way as in the illustrative embodiment in FIG. 1 and are therefore not described again.

FIG. 2 shows the end region 24, embodied so as to be substantially cylindrical, which has the same diameter $d_{23}$ as the pin region 23. Recesses 27 are formed laterally on the end region 24, with the result that the flow cross section between the injector body 10 and the nozzle needle 20 is enlarged after the partial stroke s. For this purpose, three recesses 27—in the form of ground flats in the illustrative embodiment shown—are usually distributed over the circumference, ensuring approximately uniform inflow to the second injection openings 2 while simultaneously providing good guidance of the end region 24 in the blind hole 31. At the maximum stroke v of the nozzle needle 20, however, the end region 24 can have emerged from the blind hole 31.

Figure 3:
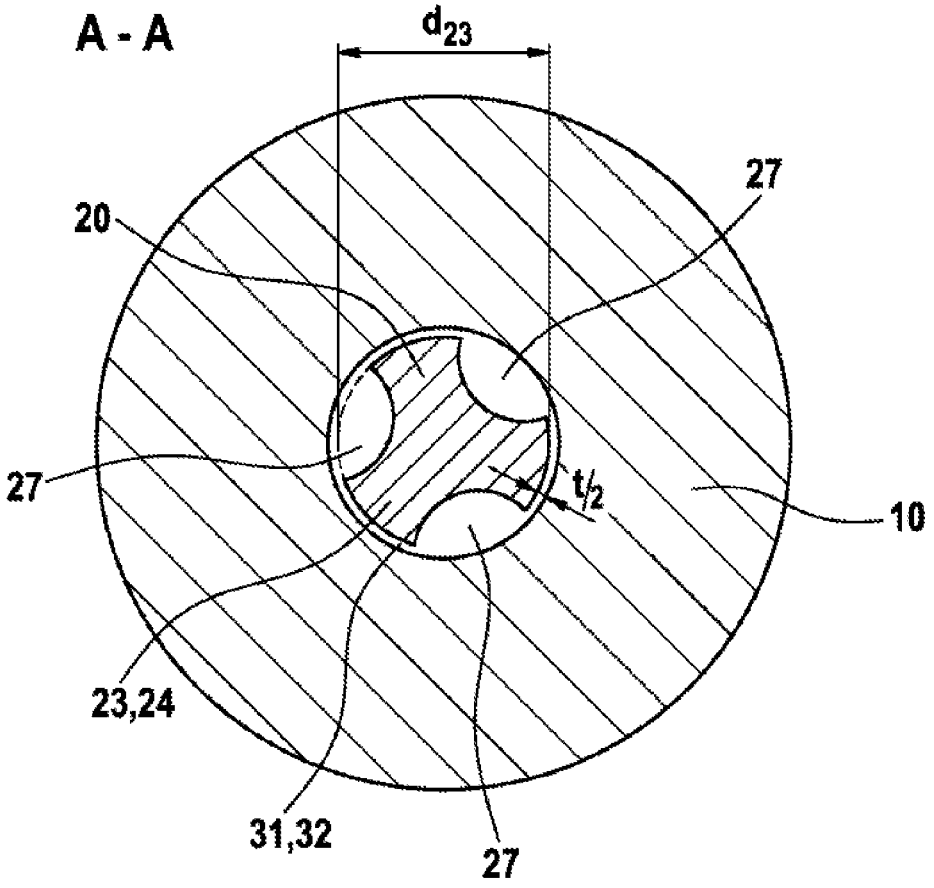
FIG. 3 shows a cross section through another illustrative embodiment of the fuel injector according to the invention.

FIG. 3 shows the section A-A from FIG. 2. The section lies in the plane of the transition from the pin region 23 to the end region 24. The throttle gap 32 of width t/2 is formed in the blind hole 31 of the injector body 10 between the injector body 10 and the nozzle needle 20, forming, together with the lateral recesses 27 arranged on the end region 24, the flow cross section in the blind hole 31. In the embodiment shown, there are three recesses 27, and the recesses 27 are of semicircular configuration in cross section.

The invention claimed is:

1. A fuel injector (100) for internal combustion engines for injecting fuel at high pressure, the fuel injector comprising a pressure chamber (30), which is formed in an injector body (10) and in which a nozzle needle (20) is arranged in a longitudinally movable manner, which nozzle needle has, at a combustion-chamber end thereof, a cone region (22), which is tapered in a combustion chamber direction, and also has a pin region (23) of constant diameter ($d_{23}$), wherein the injector body (10) has a substantially conical nozzle needle seat (17), from which at least one first injection opening (1) extends, and a blind hole (31), which adjoins the nozzle needle seat (17) at the combustion-chamber end and has a cylindrical segment having the diameter ($d_{31}$) and a hole base, from which at least one second injection opening (2) extends, wherein the cone region (22) of the nozzle needle (20) interacts with the nozzle needle seat (17) and thereby opens and closes the at least one first injection opening (1) and the at least one second injection opening (2) with respect to the pressure chamber (30), characterized in that, at least during a partial stroke (s) of the nozzle needle (20), the at least one first injection opening (1) and the at least one second injection opening (2) are connected to one another via a throttle gap (32), which is formed in the blind hole (31) between the pin region (23) and a wall of the blind hole (31) such that no portion of the pin region (23) engages the wall of the blind hole (31), and the throttle gap (32) remains constant at least over the partial stroke (s) of the nozzle needle (20), and wherein the pin region (23) emerges from the blind hole (31) and a flow cross section into the blind hole (31) is enlarged relative to the throttle gap (32) in the case of strokes of the nozzle needle (20) which are greater than the partial stroke(s).

2. The fuel injector as claimed in claim 1, characterized in that a difference between the diameter of the blind hole (31) and the diameter of the pin region (23) is greater than 6 μm and less than 30 μm.

3. The fuel injector as claimed in claim 1, characterized in that a flow cross section through the throttle gap (32) is smaller than a total flow cross section through the at least one second injection opening (2).

4. The fuel injector as claimed in claim 1, characterized in that the nozzle needle (20) has an end region (24) which adjoins the pin region (23) at the combustion-chamber end.

5. The fuel injector as claimed in claim 4, characterized in that the end region (24) is a cone.

6. The fuel injector as claimed in claim 4, characterized in that the end region (24) is substantially cylindrical and has at least one lateral recess (27).

7. The fuel injector as claimed in claim 6, characterized in that the at least one recess (27) is a ground flat.

8. The fuel injector as claimed in claim 6, characterized in that the at least one recess (27) is substantially semicircular in cross section.

9. The fuel injector as claimed in claim 1, characterized in that the flow cross section into the blind hole (31) is larger than a total flow cross section through all the second injection openings (2) in the case of a maximum stroke (v) of the nozzle needle (20) which is greater than the partial stroke (s).

10. The fuel injector as claimed in claim 1, wherein the at least one first injection opening includes a plurality of first injection openings (1).

11. The fuel injector as claimed in claim 10, wherein the at least one second injection opening includes a plurality of second injection openings (2).

12. The fuel injector as claimed in claim 1, wherein the at least one second injection opening includes a plurality of second injection openings (2).

13. The fuel injector as claimed in claim 1, wherein a flow cross section through the throttle gap (32) is smaller than a total flow cross section through the at least one second injection opening (2), the flow cross section through the throttle gap (32) amounting to between 15% and 70% of the total flow cross section through the at least one second injection opening (2) over the partial stroke (s).

14. A fuel injector (100) for internal combustion engines for injecting fuel at high pressure, the fuel injector comprising a pressure chamber (30), which is formed in an injector body (10) and in which a nozzle needle (20) is arranged in a longitudinally movable manner, which nozzle needle has, at a combustion-chamber end thereof, a cone region (22), which is tapered in a combustion chamber direction, and also has a pin region (23) of constant diameter ($d_{23}$), wherein the injector body (10) has a substantially conical nozzle needle seat (17), from which a first injection opening (1) extends, and a blind hole (31), which adjoins the nozzle needle seat (17) at the combustion-chamber end and has a cylindrical segment having the diameter ($d_{31}$) and a hole base, from which a second injection opening (2) extends, wherein the cone region (22) of the nozzle needle (20) interacts with the nozzle needle seat (17) and thereby opens and closes the first injection opening (1) and the second injection opening (2) with respect to the pressure chamber (30), characterized in that, at least during a partial stroke (s) of the nozzle needle (20), the first injection opening (1) and the at least one second injection opening (2) are connected to one another via a throttle gap (32), which is formed in the blind hole (31) between the pin region (23) and a wall of the blind hole (31), and the throttle gap (32) remains constant at least over the partial stroke (s) of the nozzle needle (20); and a flow cross section through the throttle gap (32) is smaller than a total flow cross section through the second injection opening (2), and wherein the pin region (23) emerges from the blind hole (31) and a flow cross section into the blind hole (31) is enlarged relative to the throttle gap (32) in the case of strokes of the nozzle needle (20) which are greater than the partial stroke(s).

* * * * *